US008564494B2

(12) United States Patent
Turner et al.

(10) Patent No.: US 8,564,494 B2
(45) Date of Patent: Oct. 22, 2013

(54) LIGHTWEIGHT DUAL BAND ACTIVE ELECTRONICALLY STEERED ARRAY

(75) Inventors: Earl L. Turner, Liverpool, NY (US); Kevin L. Robinson, Clay, NY (US); Blake A. Carnahan, Cazenovia, NY (US)

(73) Assignee: Howard IP Law Group, PC, Bethesda, MD (US)

( * ) Notice: Subject to any disclaimer, the term of this patent is extended or adjusted under 35 U.S.C. 154(b) by 876 days.

(21) Appl. No.: 12/013,703

(22) Filed: Jan. 14, 2008

(65) Prior Publication Data

US 2009/0179813 A1 Jul. 16, 2009

(51) Int. Cl.
*H01Q 21/00* (2006.01)

(52) U.S. Cl.
USPC ..... 343/810

(58) Field of Classification Search
USPC ..... 343/810, 795, 872, 700 MS, 702, 754; 342/371–375
See application file for complete search history.

(56) References Cited

U.S. PATENT DOCUMENTS

| | | | | |
|---|---|---|---|---|
| 5,905,466 | A | 5/1999 | Jha | |
| 2003/0076274 | A1 * | 4/2003 | Phelan et al. | 343/895 |
| 2005/0099357 | A1 * | 5/2005 | Durham et al. | 343/795 |
| 2006/0071872 | A1 * | 4/2006 | Gierow et al. | 343/872 |
| 2007/0210959 | A1 * | 9/2007 | Herd et al. | 342/368 |
| 2008/0074324 | A1 * | 3/2008 | Puzella et al. | 343/700 MS |

OTHER PUBLICATIONS

International Search Report dated Jun. 17, 2009 for related PCT/US09/30987.

* cited by examiner

*Primary Examiner* — Huedung Mancuso
(74) *Attorney, Agent, or Firm* — Howard IP Law Group, PC

(57) ABSTRACT

This invention pertains to a lightweight dual-band electronically steered phased array antenna having a multi-layer circuit for supplying DC and a ground plane to RF-on-flex subarrays. A dipole and two additional legs form a four-legged pyramid that stiffens the multi-layer circuit structure and serves as a bonding point to a radome surface. Two of the legs of the pyramid incorporate a low-band V dipole-radiating element. A third leg of the pyramid distributes RF energy to the subarrays via the multi-layer circuit. At the base of the pyramid is an open rectangular frame that accepts the insertion of the multi-layer circuit. An infrared laser transmitter distributes high and low band transmit/receive module control signals to an infrared detector on the opposite side of the subarrays.

24 Claims, 10 Drawing Sheets

LIGHTWEIGHT DUAL BAND ACTIVE ELECTRONICALLY STEERED ARRAY

FIELD OF THE INVENTION

This application relates generally to radar systems, and more particularly to multi-mode, multi-function phased array radar antennas.

BACKGROUND OF THE INVENTION

A variety of applications exist for wideband, multi-mode, multi-function apertures for electronic warfare (e.g., threat detection, threat avoidance, suppression of enemy air defenses, surveillance, and reconnaissance). In many of these applications the objectives are to reduce cost and weight for adaptive, wideband conformal phased arrays that are integrated into potential unmanned aerospace platforms. These arrays often have multiple polarization elements and perform over a wide frequency range.

For example, high-altitude airships such as gas filled dirigibles or blimps have shapes adapted for maximizing their aerodynamic performance such as lift, maneuverability and stationary or forward movements. The airship's skin materials and craft shape often challenge equipment designers in their efforts to effectively mount information gathering instrumentation, such as radar systems.

High-altitude airships also generally have challenged load and weight capabilities, which play heavily in the design of the equipment (such as lightweight phased array radar antennas) they can feasibly transport. Currently, X-Band band tile subarrays having mass density of 5 Kilograms per square meter (5 $Kg/m^2$) have been utilized. Aircraft efficiency can substantially benefit by reductions in the mass density of such arrays. Also, due to power limitations in airships the prime power density consumption should be on the order of magnitude of a few watts per square meter. Still further, an array size in the class of high-altitude airships can be several thousand square meters. Scalability from a common building block is extremely useful for manufacturing, installation and service. Alternative approaches to the design of active electronically steered phased arrays are needed.

SUMMARY OF THE INVENTION

According to an aspect of the present invention a multiband phased array antenna comprises a plurality of multi-layer circuits each having tile subarrays thereon attached to a corresponding plurality of frame supports each having a dipole-radiating element member and an RF distribution element member, electrically connected to the plurality of multi-layer circuits.

According to another aspect of the present invention, a lightweight dual-band electronically steered phased array antenna utilizes a multi-layer circuit for supplying DC and a ground plane to a plurality of RF-on-flex tile subarrays; which are mounted upon a mounting structure such as afforded by a four-legged pyramid that serves as bonding point to an opposing radome surface. Two of the legs of the pyramid incorporate a low-band V dipole-radiating element and a third leg of the pyramid distributes RF energy to the tile subarrays. At the base of the pyramid an open rectangular frame accepts the insertion of the RF-on-flex tile subarrays.

According to yet another aspect of the present invention, a lightweight dual-band electronic radar system includes a steered phased array antenna that utilizes a multi-layer circuit contained within a frame structure for supplying DC and a ground plane to a plurality of RF-on-flex tile subarrays; and a mounting pyramid wherein one or more legs of the pyramid incorporates a low-band V dipole-radiating element and one or more legs of the pyramid distributes RF energy to a plurality of tile subarrays; wherein each tile subarray is an electronically scanned antenna array that independently forms, steers, transmits and receives electromagnetic beams.

In another aspect, a lightweight dual-band active electronically steered array comprises a rigidized polyimide multi-layer circuit structure with RF-on-flex tile subarrays attached to the structure. The structure has a thin, four legged pyramid attached to the array face for low band operation. The pyramid created by the dipole adds stiffness to the structure as well as a bonding point for a radome surface. An inverted low-band V dipole radiating element is printed on two of the legs of the pyramid. A third leg distributes the RF to the element via the multi-layer circuit. At the base of the pyramid is an open rectangular frame. The high band active electronically steered phased array subarrays or tiles are inserted into the open frame and secured. The high band tiles radiate through the pyramid and radome. The tile contains the RF ground plane for both bands. The frame is a rigidized polyimide multi-layer circuit supplying DC to the tiles and providing an RF ground plane interface between pyramid/tile building blocks. The dual-band structure is adapted as an active lens for use with a space feed. High and low band Transmit/Receive (T/R) module control signals are distributed via a centralized infrared laser transmitter to IR receptors on the back of the tiles eliminating the traditional control distribution circuitry. The pyramid/tile building block can be duplicated vertically and horizontally yielding an arbitrarily large phased array that is very lightweight.

BRIEF DESCRIPTION OF THE DRAWINGS

Understanding of the present invention will be facilitated by consideration of the following detailed description of exemplary embodiments of the present invention taken in conjunction with the accompanying drawings, in which like numerals refer to like parts and.

DETAILED DESCRIPTION OF THE INVENTION

Figure 1A:
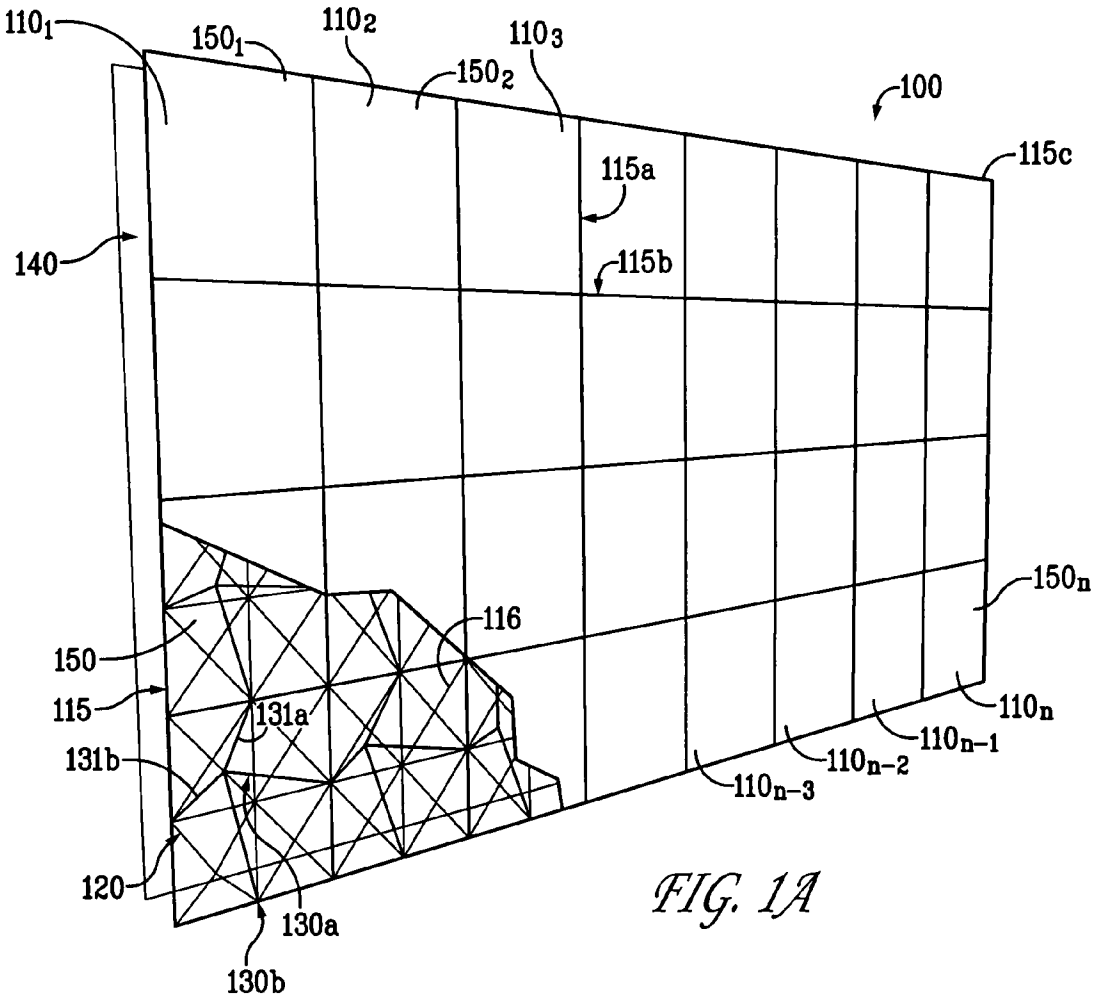
FIG. 1*a* illustrates in partial cutaway view a semi-rigid or rigidized array panel in accordance with an exemplary embodiment of the present invention.

FIG. 1*a* illustrates an exemplary embodiment of the present invention. As shown therein, a lightweight, dual band active electronically steered antenna array 100 comprises frame circuit structure embodied as a semi-rigid or rigidized polyimide circuit structure 115 having a plurality of RF-on-flex subarray tiles $\mathbf{110}_1, \mathbf{110}_2, \ldots, \mathbf{110}_{n-3}, \mathbf{110}_{n-2}, \mathbf{110}_{n-1}, \mathbf{110}_n$ (indicated generally as 110) attached to the structure. The circuit structure 115 as illustrated in the exemplary embodiment takes the form of an open rectangular frame panel adapted as an X–Y matrix of intersecting vertical 115*a* and horizontal 115*b* semi-rigid polymide members terminating at and surrounded by a peripheral portion 115*c*. The frame panel structure designated generally as 115 comprises a plurality of open subframes or panel frames $\mathbf{150}_1, \mathbf{150}_2, \ldots, \mathbf{150}_n$ (indicated generally as panel frame 150) Each RF-on-flex subarray tile 110 is adapted to be received in a corresponding subframe or panel frame 150 of frame panel structure 115.

In the exemplary embodiment, one frame panel structure 115 includes thirty two (32) subarray tiles 110, each inserted into a corresponding panel frame 150. It is understood that multiple frame panels 115 may be configured within a given stave such as a vertical stave panel segment of an airship, for example.

Figure 1B:
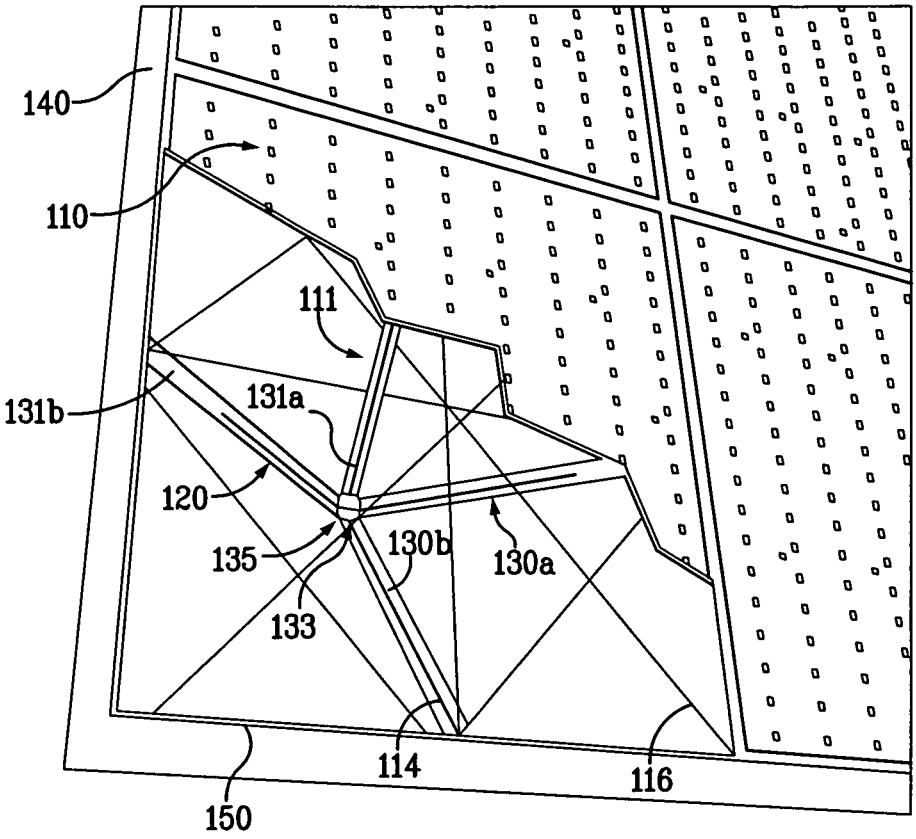
FIG. 1*b* illustrates an exploded partial cutaway view of a portion of the array panel detailing a pyramid structure that supports a corresponding tile subarray in accordance with an exemplary embodiment of the present invention.

Referring FIG. 1*a* in conjunction with FIG. 1*b*, a mounting or support structure 120 is illustrated as a pyramidal structure attached to each panel frame as shown. With reference to the above figures each mounting structure (indicated generally as 120) takes the form of a four legged pyramid having legs 130*a*, 130*b*, 131*a*, and 131*b*. Each leg attaches to a corresponding portion of the panel frame structure as shown in FIGS. 1*a* and 1*b*.

In one embodiment one or more legs of the pyramid 120 incorporates a low-band V dipole-radiating element. For example, pyramid leg 130*a* has integral thereto a printed UHF V dipole 132 (FIG. 1*c*). Pyramid leg 131 carries a UHF feed 111 that distributes RF signals to the multi-layer circuit structure and the panel elements. Pyramid leg 130*b* carries an X-band calibration feed for X-band calibration patch element 133 contained in the pyramid structure. It will be understood by those skilled in the art that although the pyramidal mounting frame design is described herein, that other designs may be implemented including rectangular frames, honeycomb frames, as well as other three dimensional geometrical structures included within the scope of the invention herein.

As best shown in FIG. 1*b* each of the RF-on-flex tiles 110 slips into a corresponding panel frame opening 150 and is held in place with allowance for expansion and contraction. The tiles interface with embedded DC lines in the frame as well as an embedded RF ground plane. In one configuration each tile is additionally supported by its contiguous tile-to-tile and interlocking frame spacing structure. As shown in FIG. 1*b* the rear side of tile 110 attaches to an open rectangular subframe or panel frame 150 and to the base of pyramid 120. As previously mentioned the pyramid 120 legs 130(*a*), 130(*b*), 131(*a*) and 131(*b*) represent respective spaced apart end portions having elongated body portions wherein the legs serve as electrical conductors. The legs also add support by way of stiffness to the structure of tile 110 as well as providing a bonding point 135 at a surface of radome 140. In this manner the pyramid structure serves to support the plurality of tiles 110 and to support the opposing radome 140. The pyramidal structure is also essentially open, as the configuration of the legs effectively define the pyramid structure, the space providing a thermal buffer that protects the array electronics from the potentially wide temperature range experienced by the radome's surface, which space also promotes convective removal of heat from both sides of the panel tiles.

In one embodiment a dipole printed circuit is integral to two of the legs of the pyramid 120. The dipole elements are preferably sized and relatively positioned within each respective dipole element array so that the multi-band phased array antenna has the required total bandwidth.

Frame cross webbing support structures 116 as shown in FIG. 1*a* and FIG. 1*b* provide support for the frame structure and tiles. In an exemplary embodiment, the cross webbing support structures comprise a plurality of thin, rigidized intersecting cross members within a panel frame. The cross webbing provides a planar surface for the tiles to lie on. The tiles 110 are inserted into the corresponding panel frames 150 and connected to the DC and RF ground plane layers of the frame.

Figure 1D:
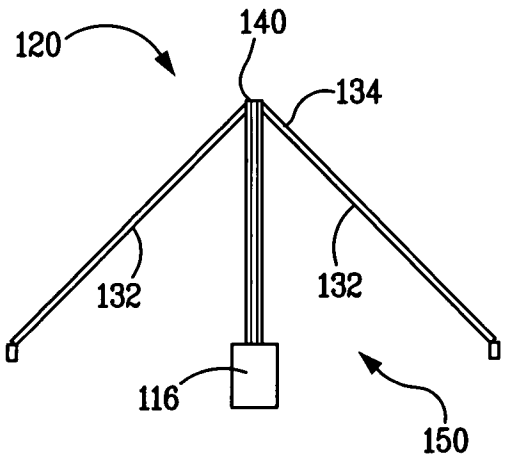
FIG. 1*d* illustrates a support structure configured as a pyramidal structure having a rigidized flex circuit with an embedded stripline and printed radiating elements in a folded condition in accordance with an exemplary embodiment of the present invention.
Figure 1C:
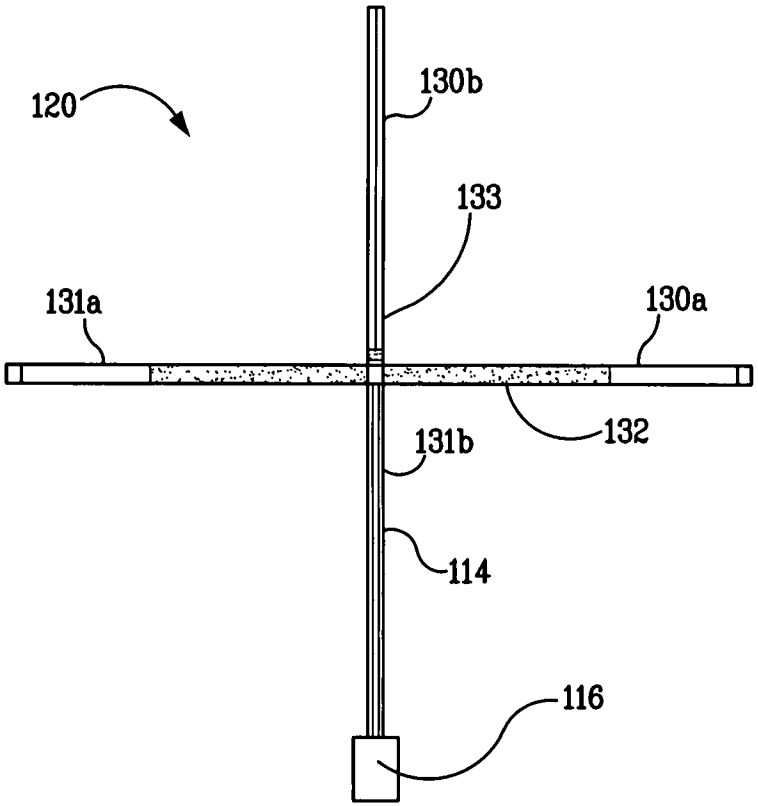
FIG. 1*c* illustrates a support structure configured as a pyramidal structure having a rigidized flex circuit with an embedded stripline and printed radiating elements in an unfolded condition in accordance with an exemplary embodiment of the present invention.

Referring to FIGS. 1*c* and 1*d* in conjunction with FIGS. 1*a* and 1*b*, the pyramid structure may be implemented as planar Kapton® flex circuits (Kapton®, is a registered trademark of DuPont) and folded into the pyramid shape with the legs bonded to the panel frame 150. FIG. 1*c* provides a more detailed illustration of a pyramid 120 flex circuit in an unfolded state while FIG. 1*d* shows a side view of the pyramid structure in the folded condition. The UHF inverted V dipole element 132 (FIG. 1*c*) and a calibration source 133 for the X-Band T/R channels, as shown in FIG. 1*c*, are printed on the pyramid structure before folding. The local X-Band calibration enables dynamic calibration for a tile, tile to tile and panel to panel. The pyramid 120 legs are connected at various positions to each panel frame as shown in FIG. 1*d* (and FIG. 6). A transceiver electronics and space feed 116 for UHF and X-Band calibration is located on pyramid leg 131*b*. In one embodiment a dipole is printed to two of the four legs of the pyramid structure with a feed line 114 passing up a third leg (131*b*).

In addition to lightweight construction the pyramid legs comprise semi-rigid polyimide flex material that absorbs the expansion and contraction of the radome 140 as well as any planar deflection. The space between the radome and the subarray tiles 110 created by the pyramids 120 provides a thermal buffer to protect the array electronics from the potentially wide temperature range experienced by the radome's surface. The space also promotes convective removal of heat from both sides of the panel tiles.

In one embodiment of the present invention, the high-band tiles 110 are fabricated from polyimide RF-on-flex material similar to that used for the pyramid structure to match the coefficient of thermal expansion.

Referring again generally to FIGS. 1*a* and 1*b*, semi-rigid or rigidized frame structure 115 contains a plurality of windows or open panel frames 150 (see e.g. FIG. 6) having the rectangular tessellation to allow insertion for mounting each of the tiles 110 to the pyramids 120. The high band active electronically steered phased array panels 110 are inserted into each semi-rigid panel frame 150 and secured thereto. Such securing may be made for example, by fastening, bonding, coupling or other securing means well known to those skilled in the art of manufacturing radar antennas. The fully assembled steered array 100 as illustrated in FIG. 1*a* has a mass density less than about 1 Kilogram (1 Kg) per square meter, which is about one fifth (⅕) the mass density of prior art lightweight designs.

The structure of pyramids 120 and tiles 110 in conjunction with the semi-rigid panel frames 150 provide a planar surface across the high band elements reducing the calibration update rate. As one can ascertain, the pyramids 120 are duplicated vertically and horizontally yielding an arbitrarily large number of lightweight panels. As shown in FIG. 1*d* (and FIG. 7), vertex 134 of the pyramid structure 120 provides a bonding point 135 of the pyramid to the radome 140 surface. Once bonded to the radome 140 the combination of the frame structure 115, pyramids 120 and radome 140 effectively form a box beam to provide stability and mechanical rigidity to the tile subarrays 110. A rigid tile structure has the ability to hold a calibration from a test signal, which may only be carried out infrequently based on the total number of elements in the array 100.

The dual-band active electronically steered array 100 supports operation at widely separated low and high bands such as VHF or UHF and X-Band. The high band tiles 110 radiate through the pyramids 120 and radome 140.

Figure 2B:
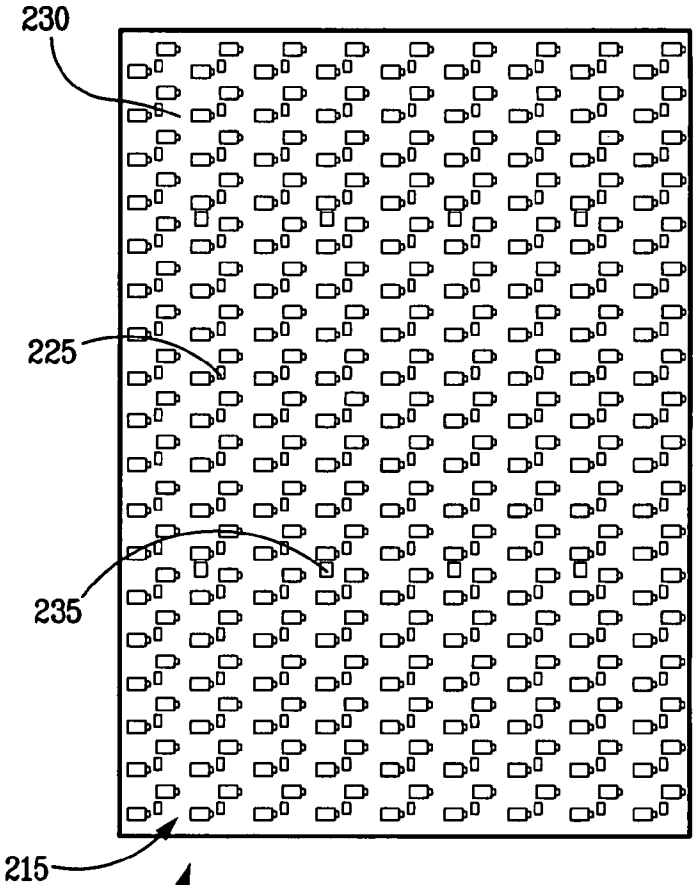
FIGS. 2*a* and 2*b* show hull and feed sides, respectively of a subarray tile element arrangement and IR sensors and T/R modules in accordance with an exemplary embodiment of the present invention.
Figure 2A:
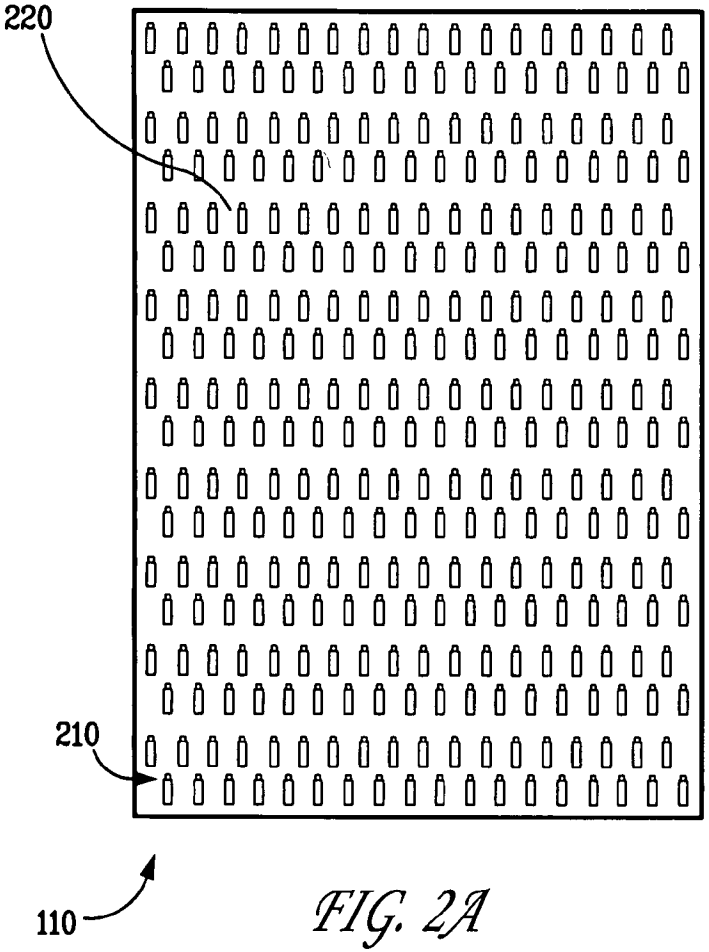

Referring now to FIG. 2, which consists of FIGS. 2*a* and 2*b*, there is shown a schematic illustration of an RF-on-flex tile subarray 110 suitable for use within the phased array structure 100 of FIG. 1*a*. FIG. 2*a* shows one side 210 of tile 110 containing radiating elements 220 as facing the radome 140 or hull surface, while FIG. 2*b* shows the opposite side or feed side 215 of tile 110. In an exemplary configuration, the steered array 100 comprises an active lens for use with the transceiver and space feed 116 (FIG. 1*c*). In the space feed, a horn, or series of horns, feeds an array of phase shifters, that electronically steer the beam. The space feed chosen in one embodiment of the invention provides a light, highly scalable device that support a centralized location of the transceivers and lens structure to compensate for any deflection. The tile 110 is fed from a horn X-band source (not shown).

The radiating elements or radiators 220 on the first side 210 in one embodiment are X-Band patch radiators for the space feed, triangular grid, and vertically polarized in RF transmission. The pattern of X-Band elements 220 are arranged in a triangular tessellation of the plane or lattice to reduce the number of X-Band elements and therefore the number of X-Band T/R modules as well. The X-Band elements may be embodied as patch elements chosen for their low weight since there is no requirement to be one quarter wavelength above the ground plane, allowing for further reduction of power. The X-Band patch elements act as a ground plane, to offer a wide azimuth scan with reduced mutual coupling and having a full band frequency response.

The feed side 215 has contained thereon radiators 230, which in one embodiment of the invention are X-Band patch radiators for the space feed and are horizontally polarized in RF transmission. The feed side 215 also has contained thereon one or more dual channel T/R modules 225 and IR command receivers 235.

In an exemplary embodiment each RF-on-flex subarray tile 100 contains three hundred twenty four (324) radiators 230, one hundred sixty two (162) T/R modules 225, and eleven (11) IR command receivers 235. The radiating elements on the feed side 215 of tile 110 interface with the space feed horn. The radiating elements on the outside array face focus the beam using the T/R modules under control of the eleven infrared optical receivers per tile. The infrared optical receiver/decoders on the RF-on-flex tile receive control commands from a laser transmitter. In one configuration the radiating element spacing is about 20.9 millimeters (mm) by 20 mm in a triangular grid on both sides. FIGS. 2*a* and 2*b* further illustrate how the X-band elements are arranged as well as where the IR sensors and T/R modules are located.

Figure 3:
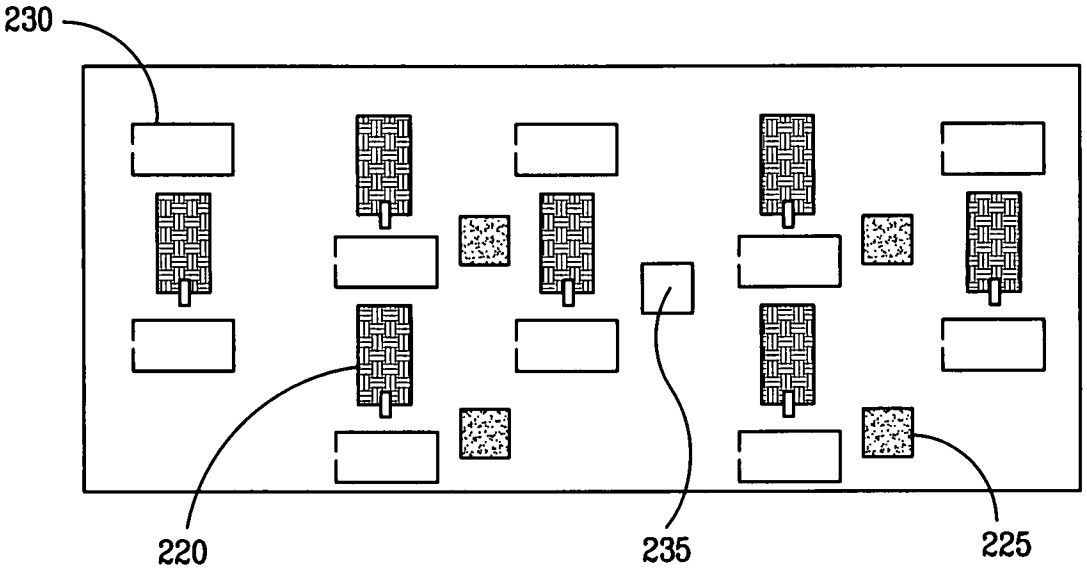
FIG. 3 is a schematic representation of a portion of an RF-on-flex subarray tile with both hull and feed sides superimposed on a single side for illustrating the T/R module relationship to two feed and radiating patch elements in accordance with an exemplary embodiment of the present invention.

Referring now to FIG. 3 there is shown an exemplary layout of the main components of an RF-on-flex subarray tile 110 according to an embodiment of the invention. As shown, both hull side 210 and feed side 215 components are shown superimposed on a segment of the tile for illustrative purposes only. Each radiating element has a corresponding feed element. A single T/R module interfaces with two radiating and feed elements as shown. The dual channel T/R module 225 is used for the high and low band transmissions. The infrared or IR command receiver 235 eliminates the traditional control distribution circuitry, having the T/R module 225 control signal distributed via a centralized infrared laser transmitter (not shown) to the respective photo detector diode receivers contained on each T/R module 225.

Figure 4:
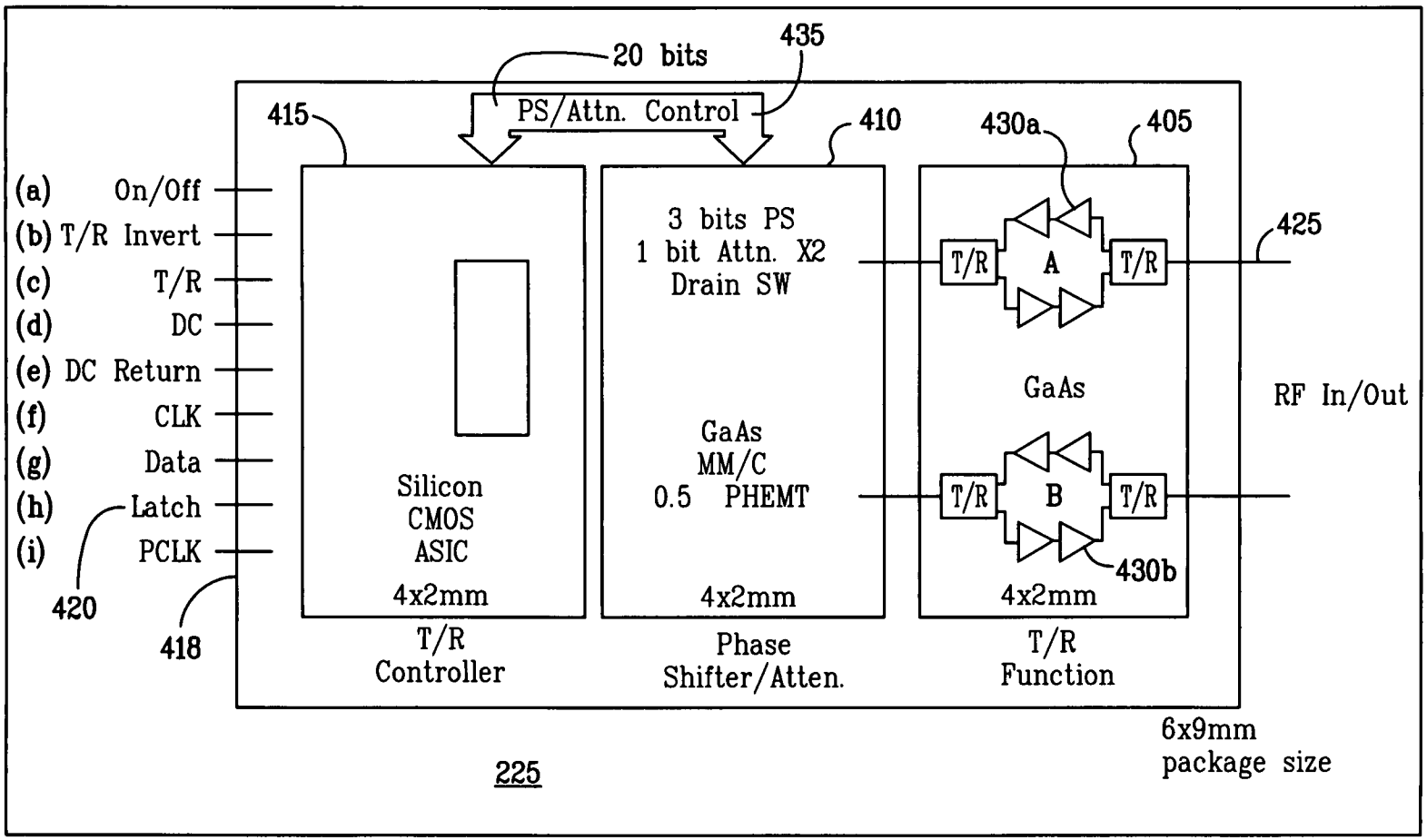
FIG. 4 is a block diagram representation of a dual-channel T/R module suitable for use in accordance with an exemplary embodiment of the present invention.

FIG. 4 shows a more detailed block diagram representation of a dual channel T/R module suitable for use as T/R module 225 illustrated in FIGS. 2 and 3. As shown in the block diagram of FIG. 4, the dual-channel X-Band T/R module 225 comprises three main circuits. The array 100 operates in the UHF and the X-band range of transmission, providing amplitude and phase control at every element. A typical T/R module 225 contains a solid-state transmitter, receiver, phase shifter, and gain control. The T/R module 225 brings the transmitters and receivers to the array face (as shown in FIG. 2 reference 215) reducing transmit power loss and receive G/T relative to passive array designs. A first circuit 405 performs the T/R function for both channels providing final transmit amplification and initial receive amplification along with the respective switching between paths. A second circuit 410 provides amplitude and phase adjustment. A third circuit 415 provides control signals to circuit 405 and to circuit 410. In an exemplary configuration, all the circuits 405, 410 and 415 respectively are packaged into a plastic package 400, which in one embodiment of the invention is about 6×9 mm in size and approximately 0.1 gram (gm) in mass-weight. The inputs and outputs to the T/R module 225 are supplied through a first port 435 and a second port 418 for inputting control input signals 420(*a-i*). Such T/R module may be embodied as a low mass T/R module package.

It is understood that the T/R module 225 and command receiver 235 (singularly the "processor" and collectively the "processors") have associated memory and operating systems with functionality selection capabilities that can be implemented in hardware, software, firmware, or combinations thereof. In a preferred embodiment, the processors functionality selection, threshold processing, panel selection and mode configuration may be implemented in software stored in the memory. It is to be appreciated that, where the functionality selection is implemented in either software, firmware, or both, the processing instructions can be stored and transported on any computer-readable medium for use by or in connection with an instruction execution system, apparatus, or device, such as a computer-based system, processor-containing system, or other system that can fetch the instructions from the instruction execution system, apparatus, or device and execute the instructions.

Further, it is understood that the subject invention may reside in the program storage medium that constrains operation of the associated processor(s), and in the method steps that are undertaken by cooperative operation of the processor(s) on the messages within the signal and data processing network. These processes may exist in a variety of forms having elements that are more or less active or passive. For example, they exist as software program(s) comprised of program instructions in source code or object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals, whether modulated using a carrier or not, are signals that a computer system hosting or running the computer program may be configured to access, including signals downloaded through the Internet or other networks. Examples of the foregoing include distribution of the program(s) on a CD ROM or via Internet download.

The same is true of computer networks in general. In the form of processes and apparatus implemented by digital processors, the associated programming medium and computer program code is loaded into and executed by a processor, or may be referenced by a processor that is otherwise programmed, so as to constrain operations of the processor and/or other peripheral elements that cooperate with the processor. Due to such programming, the processor or computer becomes an apparatus that practices the method of the invention as well as an embodiment thereof. When implemented on a general-purpose processor, the computer program code segments configure the processor to create specific logic circuits. Such variations in the nature of the program carrying medium, and in the different configurations by which computational and control and switching elements can be coupled operationally, are all within the scope of the present invention.

Figure 5:
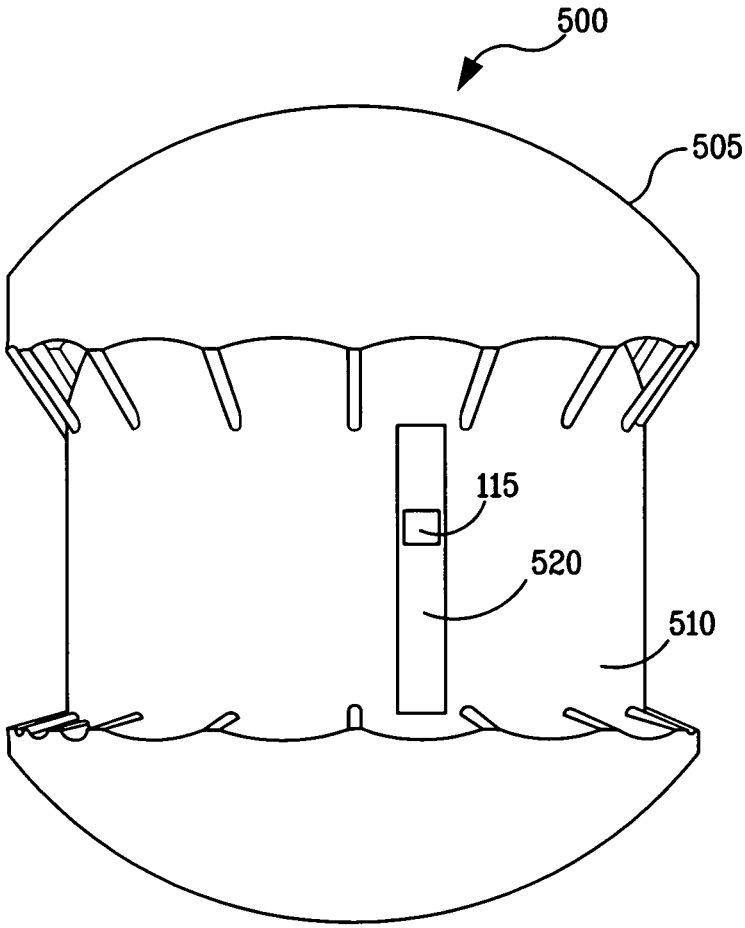
FIG. 5 is a schematic representation of a pressurized cylinder or bladder assembly adapted to fit within the hull structure of an airship and containing a rigidized array panel in accordance with an exemplary embodiment of the present invention.

Referring now to FIG. 5, there is shown a perspective view of a pressurized cylinder or bladder assembly 500 containing the antenna array frame panel structure 100 of FIG. 1. As shown, assembly 500 includes a pressurized structure 510 in the form of a cylinder, sphere, or other suitable geometric arrangement and containing a plurality of vertical staves 520 (1 being shown in the exemplary drawing) about the surface of the structure (e.g. cylinder). In the exemplary embodiment, each stave 520 contains a plurality of frame panel structures 115 (FIG. 1) for the antenna array 100 (FIG. 1), one of which is shown in FIG. 5 for illustrative purposes only. Each panel array is arranged such that signals and power are sent to various subsets of tiles 110 within each panel array to form one or more active radars. The cylinder is preferably made of the same material as the airship hull (e.g. radome material) and is surrounded by a protective interface support structure 505 and attached thereto for retaining the cylinder and maintaining the structure within a predetermined position in the airship. The interface support structure 505 is preferably made of the same airship hull material (or multi-layer fabric). The interface support structure 505 exterior surface is contoured so as to be mounted inside or beneath the airship so that the cylinder 510 with the staves oriented vertically form a beam at a given azimuth, a subset of panels or staves whose average normal is closest in azimuth to the desired beam azimuth are electronically identified. Based upon the IR command 235 control signals the selected staves or panels form radar beams whose outputs are coherently combined, and if necessary, appropriate phase progressions are applied to electronically steer the net beam to the desired angle.

Figure 8:
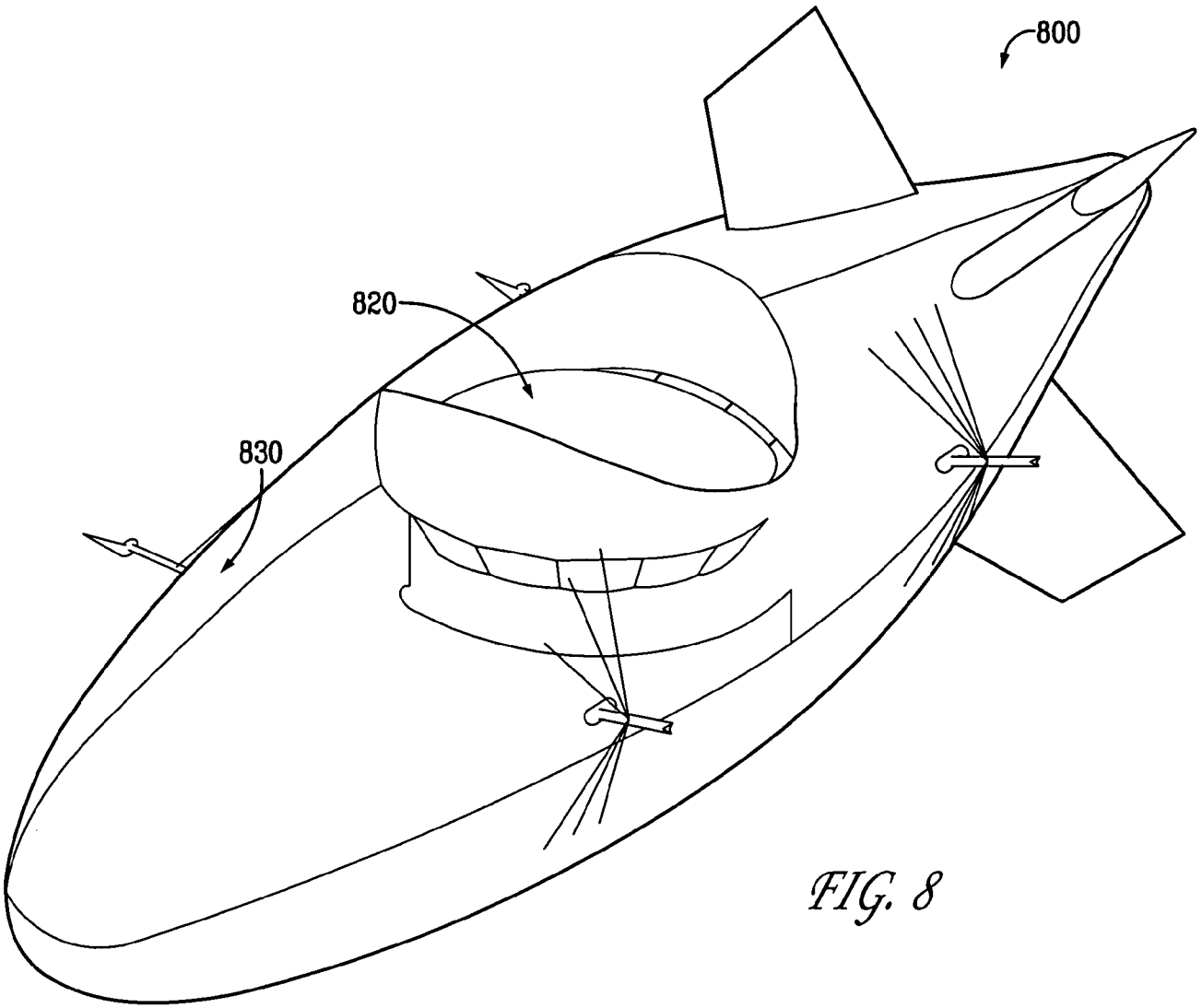
FIG. 8 shows an exemplary illustration of an airship and hull structure for mounting the array in accordance with the principles of the present invention.

In one exemplary embodiment of the invention, the array 100 of FIG. 1 is bonded to portions of the airship hull. An exemplary airship 800 useful for implementing the present invention is illustrated in FIG. 8. The array may be bonded to the interior 830 of the hull structure of the airship. In another exemplary embodiment, the array 100 is contained within an assembly (e.g. an assembly 500 shown in FIG. 5) that is mounted within the airship hull. As shown in FIG. 8, airship 800 may be adapted to accommodate in cavity 820 a suitably shaped assembly 500 (FIG. 5) containing an antenna array structure depicted, for example, in FIG. 1. The assembly may be mounted on or in the airship 800. It is understood that suitable mounting structures, such as brackets, ties, adhesives and the like, may be useful in securing the assembly and/or the array to the hull structure. In one embodiment of the present invention, a 1.44 m high by 3.01 m wide array panel, as shown in FIG. 1*a*, consists of 32 X-Band RF-on-flex tile 110 arrays mounted in a structure that has 32 integral UHF radiating elements. Each tile 110 has 324 X-Band radiating elements (18 wide by 18 high) in a triangular grid. The X-Band spacing is chosen to be more than a half wavelength at X-Band to allow for a +/−60 degree steering in both dimensions without grating lobes in real space. A summary of the array 100 features in one embodiment of the present invention is included in Table 1.

TABLE 1

| | |
|---|---|
| Frame Panel Structure | Dimensions: 3.01 m wide × 1.44 m high × 0.17 m deep<br>Number of RF-on Flex tiles: 32<br>Elements per panel: 32 UHF elements and 10,368 X-Band elements<br>TR modules: 5,184 dual channel modules interfacing with 2 feed elements and 2 radiating elements<br>Mass Density: Less than 1 kg/m$^2$ fully populated with electronics and support structures |
| RF-on-Flex Panel/Tile | Dimensions: 0.3672 m wide × 0.36 m high<br>No. of X-Band Elements: Triangular lattice of 18 rows × 18 columns = 324 feed side and 324 radiating side elements<br>Element spacing: 20.9 mm Horizontal × 20.0 mm Vertical<br>X-Band Polarization: Vertical for radiating elements<br>TR module Phase and amplitude controlled via 11 infrared (IR) detectors |
| UHF Pyramid | One integrated UHF inverted V dipole per pyramid arranged in a rectangular lattice across the panel<br>UHF Polarization: Horizontal<br>One X-Band calibration patch per pyramid |

TABLE 1-continued

| | |
|---|---|
| | Transceive electronics for X-Band calibration and UHF located on pyramid leg extension |
| Beamforming & Control | X-Band Beamforming: Space feed<br>UHF Beamforming: Space feed or constrained<br>IR Control: Laser transmitter distributes command data to IR detectors |

The weight limitations in airships require an alternative approach to the design of active electronically steered phased arrays. The foregoing features of the invention provide for such reductions. Table 2 shows an exemplary embodiment of the array 100 support structure mass density normalized to one tile 110.

TABLE 2

| Support Structure Component | Length (meters) | Width (mm) | Thick (mm) | Length (inches) | Width (inches) | Thick (inches) | Qty/ tile | Mass/tile (grams) | Area/Density (grams/m$^2$) |
|---|---|---|---|---|---|---|---|---|---|
| Panel Frame width | 0.377 | 0.5080 | 10.160 | 14.842 | 0.02 | 0.04 | 5 | 13.62067 | 100.3586 |
| Panel Frame height | 0.36 | 0.5080 | 10.160 | 14.173 | 0.02 | 0.04 | 5 | 13.00648 | 95.833 |
| UHF dipole quad legs | 0.252 | 20.0 | 0.2540 | 9.938 | 0.787 | 0.01 | 4 | 7.181 | 52.91 |
| UHF Dipole attachment spot | 0.02 | 20.0 | 0.2540 | 0.787 | 0.787 | 0.01 | 1 | 0.1422 | 1.048 |
| UHF/X cal feed | 0.185 | 10.0 | 0.5080 | 7.283 | 0.394 | 0.02 | 1 | 1.3157 | 9.694 |
| Bonding Media | | | | | | | | 25 | 184.2 |
| | | | | | | | Total | 60.3 | 444 |

Table 3 shows the array 100 RF-on-flex Tile with electronics mass density.

TABLE 3

| RF Flex Tile with Electronics | Length (meters) | Width (meters) | Thick (mm) | Length (in) | Width (in) | Thick (in) | Qty/ tile | Mass/tile (grams) | Area/Density (grams/m$^2$) |
|---|---|---|---|---|---|---|---|---|---|
| RF Flex Tile | 0.377 | 0.36 | 0.130 | 14.84 | 14.17 | 0.005 | 1 | 38.6 | 285.0 |
| 162 X-Brand TR modules (0.1 gram each) | | | | | | | 162 | 16.2 | 119.4 |
| 11 IR Command receivers (0.1 grams each) | | | | | | | 11 | 1.1 | 8.1 |
| 1 UHF TR Modules (10 grams each) | | | | | | | 1 | 10.0 | 73.7 |
| | | | | | | | | Total | 486.0 |

Figure 6:
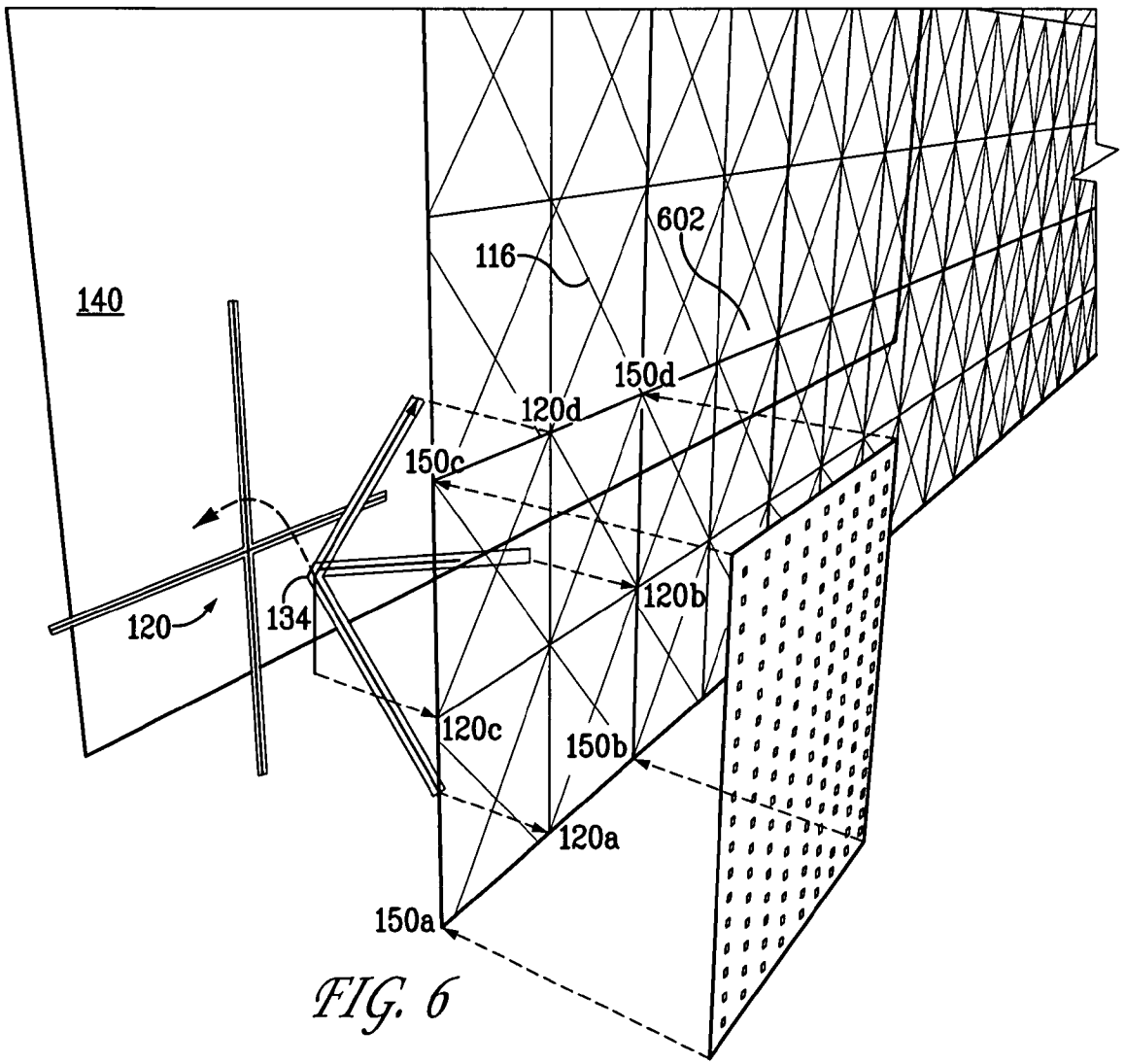
FIG. 6 illustrates a perspective view of an assembly process of a rigidized array panel in accordance with an exemplary embodiment of the present invention.

FIG. 6 is a perspective view similar to that of FIG. 1*a* and useful for describing assembly operations for forming the array 100 according to an exemplary embodiment of the present invention. Referring to FIG. 6 in conjunction with FIG. 1*a*, the frame structure indicated generally as 115 is fashioned as a grid or matrix and fabricated from a plurality of horizontal (e.g. 5) and vertical (e.g. 9) interlocking rigidized multi-layer flex circuits bonded together at the intersections. The grid has corresponding integral DC and RF ground plane layers 602 embedded therein. Each of the RF-on-flex tiles 110 are constructed from a plurality of T/R modules 225, IR Command receivers 235 and X-Band patch radiators 230 assembled using, for example, an automated solder surface mount process well known to those in the art of manufacturing circuit boards. IR optical receivers 235 are generally mounted last to prevent damage from assembly. Successful tile assembly requires the tiles to remain in a controlled tension and/or flatness through the assembly, solder, inspection, cleaning and handling processes, until insertion into the corresponding panel frame 150.

The panel 110 tiles require mechanical rigidity, which as indicated above is provided by a light weight, semi-rigid support structure that serves multiple purposes and provides direct interface with the airship hull at each tile. The pyramid 120 mounting structure is bonded to the panel frame 150 structure. Each panel frame structure 150 forms a part of the overall frame 115 and is fabricated from semi rigid Kapton® material with embedded circuits (e.g. copper circuits) 602 to distribute DC and RF power. Thin polyimide cross webs 116 add strength across the panel 110 installation. Essentially the cross web 116 affords a planar surface on which the tiles lay. The cross web 116 is then bonded to the gird to enhance lateral structural strength. The RF-on-flex tiles 110 slip into the panel frame 150 (e.g. at 150*a*, 150*b*, 150*c*, 150*d*) and interface with the embedded copper circuits 602, such as the DC lines in the frame 150 as well as an embedded RF ground plane in the frame 150. The pyramid 120 structures start as planar Kapton® flex circuits and are folded as shown in FIG. 1*d* and FIG. 6 into the pyramid 120 shape, whereupon the legs 130*a*, 130*b*, 131*a* and 131*b* are bonded to the frame 150 (e.g. at positions 120*a*, 120*b*, 120*c*, 120*d*).

One embodiment of the present invention is a fabrication method for making a multiband phased array antenna 100 comprising: providing a plurality of multi-layer circuit structures having thereon the RF-on-flex tile; and forming a pyramidal frame support having legs at least two of which supply a plurality of dipole elements extending outwardly from the pyramidal frame support vertex 134, and attaching, as by way of example bonding, the multi-layer circuits structure to the base of the four legs of the pyramid and arranging the plurality of pyramids in a rectangular tessellation. In addition the method of fabrication includes attaching as by way of example bonding the pyramid vertex 134 to the radome 140 surface.

Figure 7A:
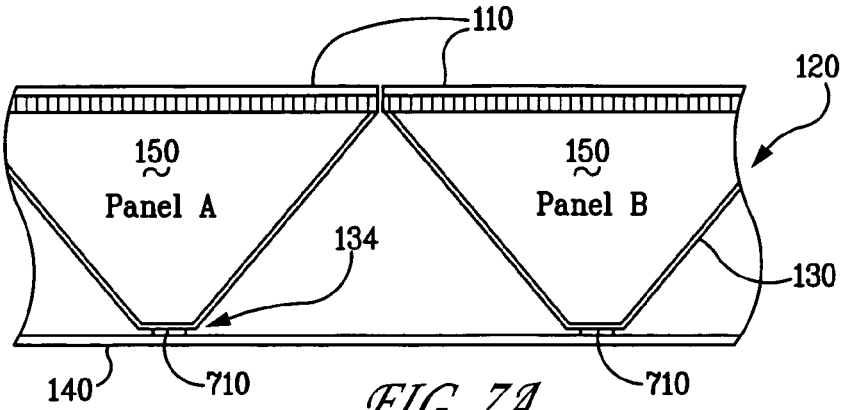
FIG. 7 shows hull material bonding mechanisms in accordance with an exemplary embodiment of the present invention.
Figure 7B:
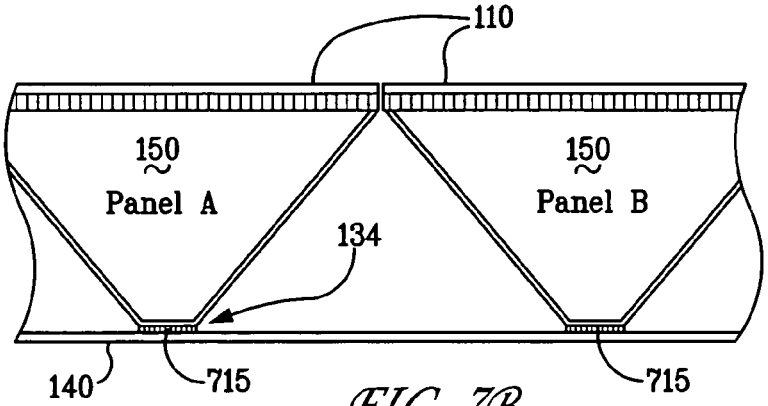
Figure 7C:
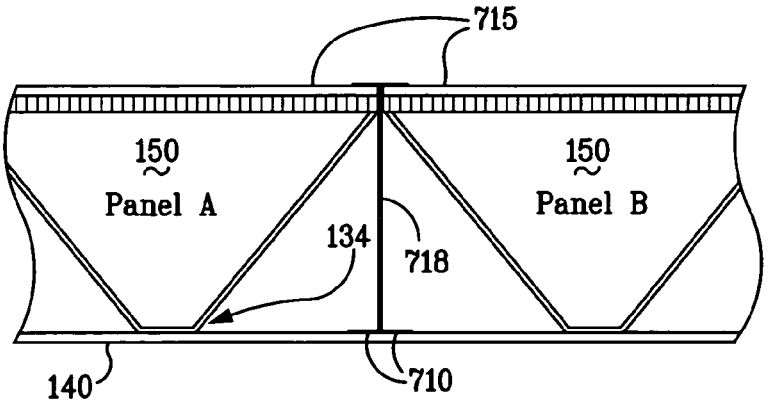

As shown in FIG. 7, which consists of FIGS. 7*a*, 7*b*, and 7*c*, a feature of the invention is that it offers efficiency for large-scale manufacturing. In part this is because the tile 110 construction, weight and size reduces complexities generally observed in the prior art. As shown in FIG. 7 bonding options affording alternate embodiments of the invention include an adhesive 710 such as silicone and hook and loop 715 and/or tape 718. The inventors have found that the bonding solution as depicted in FIG. 7 satisfies the following criteria: 1) −80 degrees Celsius (C.) low temperature operation; 2) diurnal cycling of a 60 degree C. change; 3) Thermal expansion due to tile 110 heat load, internal hull temperature, outside hull temperature in addition to compatible coefficient of thermal expansions between the hull and panel materials; 4) ease of installation and removal of the panel as required for maintenance and repair. In part the thermal expansion is addressed by the tile 110 structures and the UHF dipole support legs having a relative resilience in addition to a shear tolerance of the attaching media.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A multiband phased array antenna comprising:

a plurality of multi-layer circuits having tile subarrays thereon, each tile subarray attached to a corresponding one of a plurality of discrete frames, each discrete frame comprising a plurality of support members including a dipole-radiating element member and an RF distribution element member electrically connected to the plurality of multi-layer circuits, wherein the plurality of discrete frames and corresponding tiles are configured to be joined together to form a scalable array antenna.

2. The multiband phased array antenna according to claim 1, wherein each of the plurality of discrete frames directly supports an opposing radome.

3. The multiband phased array antenna according to claim 1, wherein each frame is in the form of a four legged pyramid.

4. The multiband phased array antenna according to claim 1, wherein the pyramid includes a base, at the base of the pyramid an open rectangular frame accepts the insertion of the subarray tiles.

5. The multiband phased array antenna according to claim 1, wherein the dipole-radiating element is a printed circuit conductive layer.

6. The multiband phased array antenna according to claim 5, wherein the dipole-radiating element is an inverted low-band V dipole.

7. The multiband phased array antenna according to claim 1, wherein the frames are arranged in rows and columns.

8. The multiband phased array antenna according to claim 2, wherein tiles radiate through the pyramids and radome.

9. The multiband phased array antenna according to claim 1, wherein the tiles contain an RF ground plane for the transmission frequency bands.

10. The multiband phased array antenna according to claim 3, wherein each pyramid and associated tile has a mass density less than 1 Kilogram per square meter.

11. The multiband phased array antenna according to claim 3, wherein each pyramid and associated tile has a semi-rigid frame structure that provides a planar surface across the high band elements for reducing the calibration update rate.

12. The multiband phased array antenna according to claim 1, wherein the multi-layer circuits are constructed from polyimide material.

13. The multiband phased array antenna according to claim 1, wherein the subarray tiles are RF-on-flex tiles.

14. A multiband phased array antenna comprising a plurality of multi-layer circuits configured as a frame panel; a plurality of RF-on-flex subarray tiles, wherein each of the multi-layer circuits are coupled to a discrete pyramidal frame that serves as bonding point to an opposing radome surface, each discrete pyramidal frame having two legs that incorporate a low-band V dipole-radiating element, a third leg that distributes RF energy to the subarray tiles, and a base that forms a sub frame of said frame panel to accept the insertion of a corresponding one of the subarray tiles, wherein the plurality of discrete pyramidal frames and corresponding subarray tiles are configured to be joined together to form a scalable array antenna.

15. The antenna of claim 14, wherein the pyramidal frame comprises a semi-rigid flex material.

16. The antenna of claim 14, wherein the subarray tiles comprise a polymide material.

17. A method for making a multiband phased array antenna comprising:

providing a plurality of multi-layer circuits; and forming a pyramidal frame support having legs which supply a plurality of dipole elements extending outwardly from the pyramidal frame support vertex, and attaching the multi-layer circuits to the base of the four legs of the pyramidal frame support and arranging the pyramidal frame in a rectangular tessellation.

18. The method of claim 17, further including providing RF-on Flex tiles to the frame support.

19. The method of claim 17, further including bonding the pyramidal frame to the multi-layer circuits.

20. The method of claim 17, further including bonding the pyramidal frame vertex to a radome.

21. A multiband phased array antenna comprising:

a plurality of multi-layer circuits;

a pyramidal frame support having legs which supply a plurality of dipole elements extending outwardly from the pyramidal frame support vertex, and multi-layer circuits attached to the base of the four legs of the pyramidal frame support, wherein the pyramidal frame in arranged in a rectangular tessellation.

22. The antenna of claim 21, further comprising RF-on Flex tiles provided on the frame support.

23. The antenna of claim 21, wherein the pyramidal frame is bonded to the multi-layer circuits.

24. The antenna of claim 21, wherein the pyramidal frame vertex is bonded to a radome.

* * * * *